US005729816A

United States Patent [19]

Matsumoto et al.

[11] Patent Number: 5,729,816

[45] Date of Patent: Mar. 17, 1998

[54] SHEET CONVEY APPARATUS

[75] Inventors: Kazuhiro Matsumoto, Yokohama; Kenichi Suzuki, Isehara; Hajime Nakajima, Tokyo, all of Japan

[73] Assignee: Canon Kabushiki Kaisha, Tokyo, Japan

[21] Appl. No.: 504,787

[22] Filed: Jul. 20, 1995

[30] Foreign Application Priority Data

Jul. 25, 1994 [JP] Japan ..... 6-192941

[51] Int. Cl.[6] ..... G03G 21/00; B65H 9/16

[52] U.S. Cl. ..... 399/381; 271/251

[58] Field of Search ..... 271/184, 251, 271/185, 225, 227, 3.1; 399/401, 381; 355/407

[56] References Cited

U.S. PATENT DOCUMENTS 5,162,857 11/1992 Higeta et al. ..... 399/401

5,485,189 1/1996 Ebata ..... 271/251

5,564,544 10/1996 Takemoto et al. ..... 271/251

*Primary Examiner*—D. Rutledge

*Attorney, Agent, or Firm*—Fitzpatrick, Cella, Harper & Scinto

[57] ABSTRACT

The present invention provides a sheet convey apparatus comprising a first pair of convey means at least one of which has a driving force and which are adapted to pinch and convey a sheet, a second pair of convey means at least one of which has a driving force and which are adapted to pinch and convey the sheet and which are disposed at a downstream side of and adjacent to the first pair of convey means, and a third pair of convey means at least one of which has a driving force and which are adapted to pinch and convey the sheet and which are disposed at a downstream side of and adjacent to the second pair of convey means and wherein a conveying direction of the second pair of convey means is different from those of the first and third pair convey means other than a right angle.

13 Claims, 8 Drawing Sheets

SHEET CONVEY APPARATUS

BACKGROUND OF THE INVENTION

1. Field of the Invention

The present invention relates to a sheet convey apparatus used with an image forming apparatus in which an image is formed on a sheet and is developed.

2. Related Background Art

In the past, sheet convey apparatuses have widely been used for conveying a sheet in image recording apparatuses, image developing apparatuses and the like, and such sheet convey apparatuses have various designs and sheet conveying directions.

SUMMARY OF THE INVENTION

An object of the present invention is to provide simple and inexpensive sheet convey apparatus which does not require an exclusive means for shifting a sheet and in which a sheet is shifted while being continuously conveyed, a sheet convey time can be reduced and the sheet can be conveyed stably and positively.

The other objects and features will be apparent from the following detailed descriptions referring to the accompanying drawings.

DESCRIPTION OF THE PREFERRED EMBODIMENTS

Now, the present invention will be fully explained in connection with embodiments shown in FIGS. 1 to 11.

Figure 1:
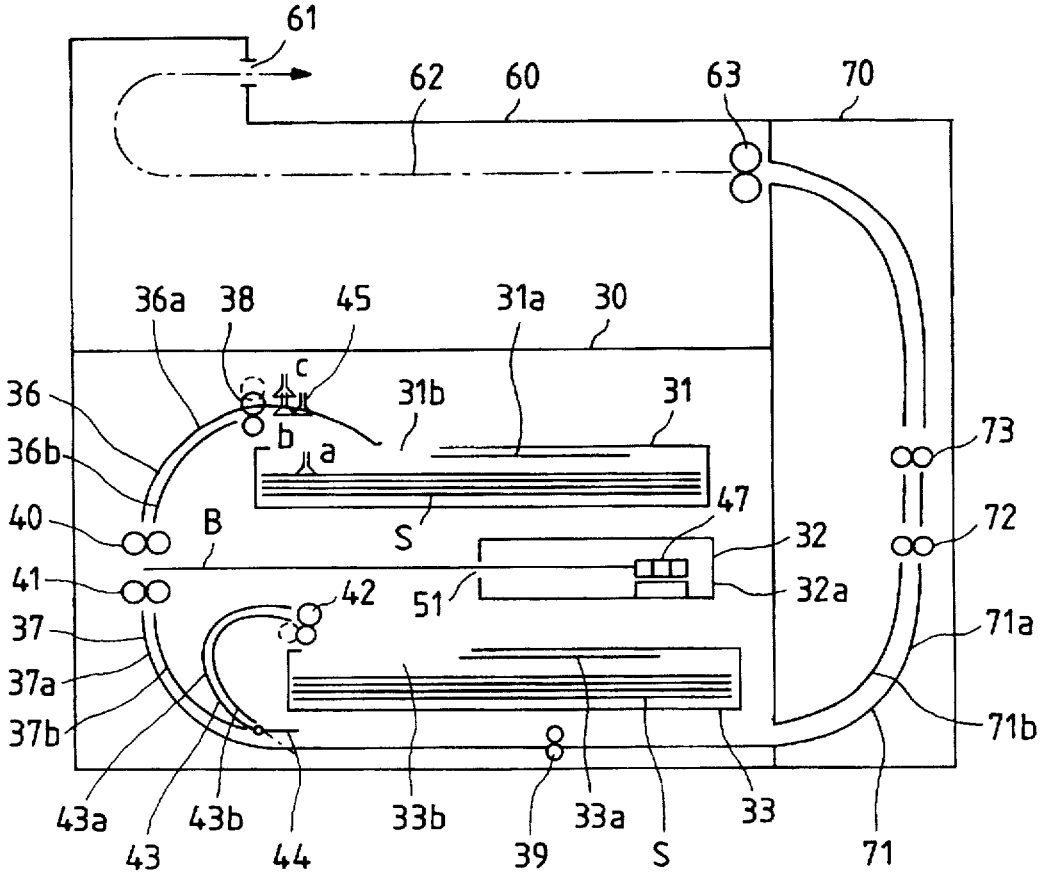
FIG. 1 is an elevational sectional view of an image forming apparatus to which a first embodiment of the present invention is applied.

FIG. 1 is an elevational sectional view of an image forming apparatus according to a first embodiment of the present invention. The image recording apparatus 30 includes an upper supply magazine 31, an intermediate optical unit 32, and a lower receiver magazine 33, which elements 31 to 33 are in parallel with each other in a horizontal direction and are arranged side by side in a vertical direction. Within the supply magazine 31, non-used film sheets S are stacked with their exposure surfaces facing downwardly, and the receiver magazine 33 serves to receive the recorded film sheets S. The magazines 31, 33 are provided with openings 31*b*, 33*b* having openable lids 31*a*, 33*a* so that the interior of each magazine 31, 33 can be light-righted by closing the lids 31*a*, 33*a*.

Arcuate convey paths 36, 37 comprising parallel outer and inner guides 36*a*, 36*b* and 37*a*, 37*b*, respectively, extend between the opening 31*b* of the supply magazine 31 and the opening 33*b* of the receiver magazine 33 and are adjacent to each other to form a semi-circular path. The outer guide 36*a* of the convey path 36 is extended over the opening 31*b* to partially cover the opening 31*b* and the guide 37*a* of the convey path 37 is extended below the receiver magazine 33 in parallel with the opening up to an opening formed in a right side wall of the apparatus.

A first convey roller pair 38 comprising upper and lower rollers is disposed at an end of the convey path 36 near the opening 31*b*. The roller pair 38 includes at least one drive roller, and the upper short roller is shiftable through an aperture formed in the guide 36*a* between an engage position where the upper roller is urged against the lower roller as shown by the solid line and a disengage position where the upper roller is separated from the lower roller as shown by the broken line.

Further, a second convey roller pair 39 comprising upper and lower rollers is disposed in the extension of the convey path 37, and first and second slow-scan roller pairs 40, 41 are disposed between a back end (in a conveying direction) of the convey path 36 and a front end (in the conveying direction) of the convey path 37.

A receiving convey roller pair 42 comprising upper and lower rollers is disposed above a front end or left side of the receiver magazine 33. The lower roller of the roller pair 42 can be retarded to a position shown by the broken line. Further, a convey path 43 comprising a pair of arcuate guides 43*a*, 43*b* extends from the receiving convey roller pair 42 and is connected to the convey path 37.

A movable guide 44 is pivotally mounted on a lower end of the outer guide 43*a* so that the movable guide can be shifted between a closed position where the convey path 37 is blocked by the movable guide as shown by the broken line and an open position where the convey path 37 is not blocked by the movable guide as shown by the solid line. A notch is formed in the guide 37*a* at a position corresponding to a tip end of the movable guide 44 so that, when the convey path 37 is blocked by the movable guide, the movable guide 44 does not contact with the guide 37*a*.

On the other hand, a plurality of suction cups 45 are disposed above the extension of the guide 36*a* and arranged side by side along a direction perpendicular to the plane of FIG. 1 and can be shifted through a notch formed in the guide extension 36*a* by means of a drive mechanism (not shown) so that the suction cups can be moved between a position a within the supply magazine 31, a position b in front of the first convey roller pair 38 and a position c above the position b.

Figure 2:
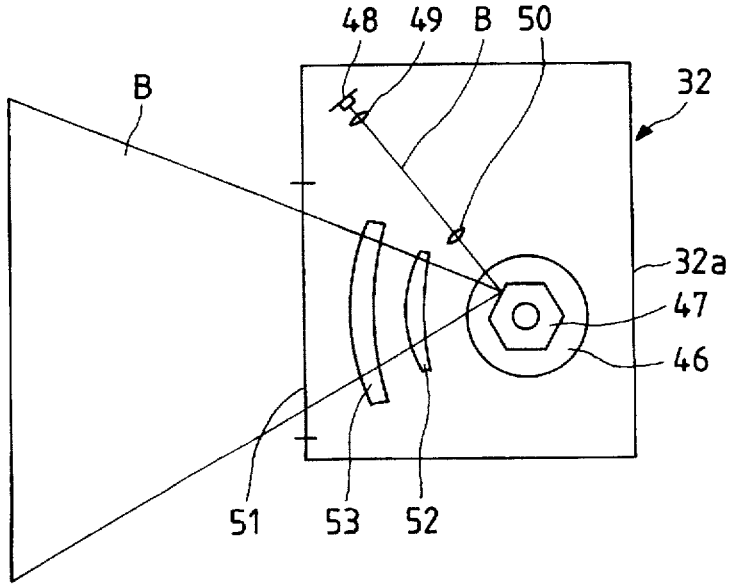
FIG. 2 is a plan view of an optical unit.

As shown in FIG. 2, the optical unit 32 includes a casing 32*a* within which a rotatable polygon mirror 47 connected to a motor 46, a laser light source 48 for emitting a laser beam B toward the polygon mirror, and two lenses 49, 50 disposed between the laser light source and the polygon mirror are contained. Further, an exit window 51 is formed in the casing 32*a* to send the laser beam between the first and second slow-scan roller pairs 40 and 41, and first and second scan lenses 52, 53 are disposed between the rotatable polygon mirror 47 and the exit window 51.

A developing apparatus 60 is installed on the image recording apparatus 30, and a connection unit 70 is disposed at the right side of the image recording apparatus 30 and the developing apparatus 60. Within the developing apparatus 60, there is disposed a convey path 62 extending from an opening formed between the developing apparatus and the connection unit 70 to a discharge opening 61 formed in an upper side wall of the developing apparatus. Although not shown, various developing elements are disposed along the convey path 62.

Further, within the connection unit 70, there is disposed a convey path 71 comprising a pair of inner and outer guides 71*a*, 71*b*, which convey path 71 is connected to the convey path 37 of the image recording apparatus 30 and to the convey path 62 of the developing apparatus 60. The convey path 71 includes a third convey roller pair 72 and a fourth convey roller pair 73. Further, a fifth convey roller pair 63 is disposed in the vicinity of the entrance of the convey path 62 of the developing apparatus 60. In this way, a shift convey mechanism is constituted by the second, third, fourth and fifth convey roller pairs 39, 72, 73, 63 and the convey path 71.

Figure 3:
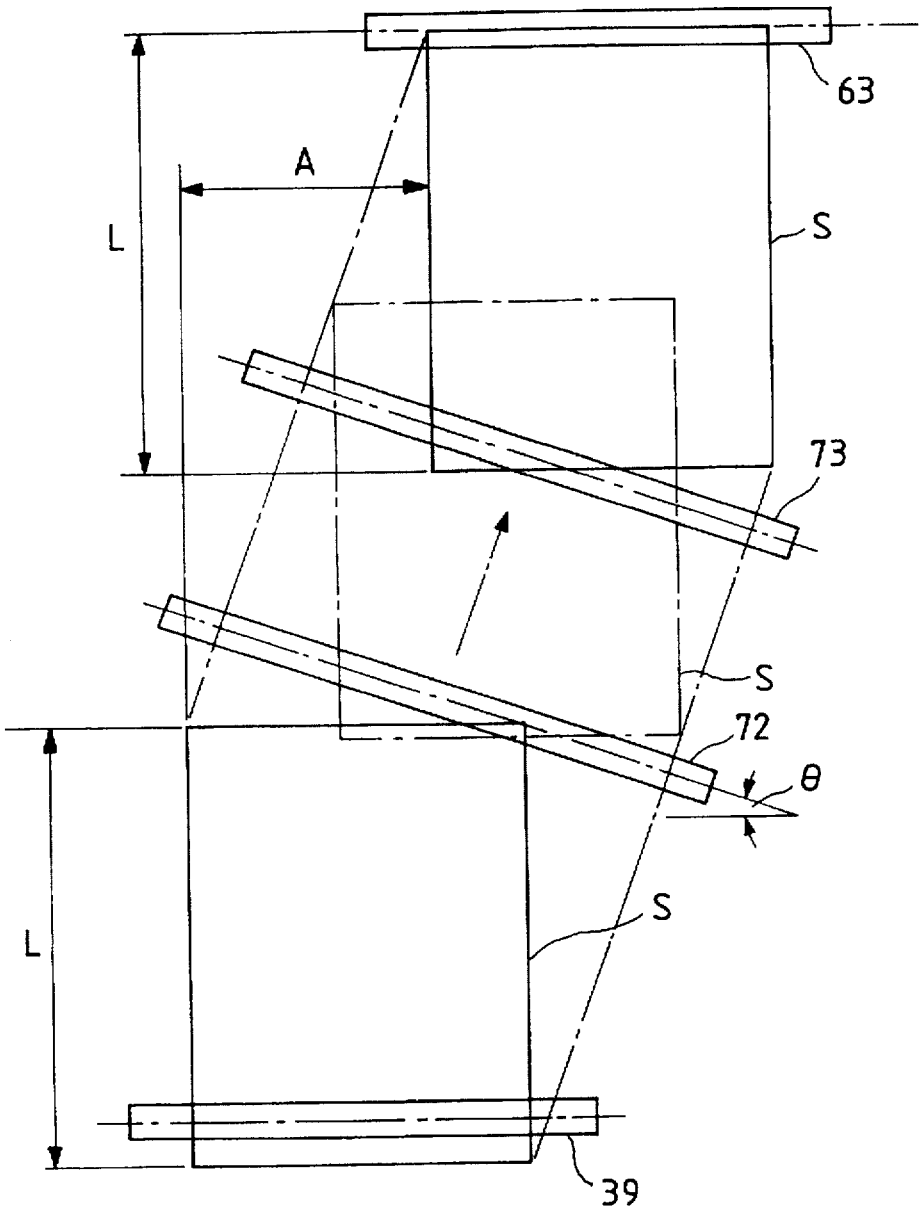
FIG. 3 is an explanatory view showing arrangement of a convey means in a shift convey mechanism.

As shown in FIG. 3, the third convey roller pair 72 and the fourth convey roller pair 73 are disposed in parallel with each other and are inclined with respect to the second and fifth convey roller pairs 39, 63 by an angle θ.

Further, the second, third, fourth and fifth convey roller pairs 39, 72, 73, 63 are spaced apart from each other by a distance smaller than a length L of a sheet to be conveyed so that the sheet is always pinched by two roller pairs. In addition, the convey path 37 of the image recording apparatus 30 is displaced from the convey path 62 of the developing apparatus 60 by a distance A.

With this arrangement, when an image is formed on the sheet by the image recording apparatus 30, the suction cups 45 of the image recording apparatus 30 are driven by the drive mechanism (not shown) to pick up the uppermost film sheet S from the supply magazine 31 at the position a. In this case, the rollers in the first convey roller pair 38 are rotated while being contacted with each other. Then, after the suction cup 45 are shifted to the position b, when a tip end of the film sheet S is pinched by the first convey roller pair 38, the suction cups 45 release the film sheet S and are retarded to the position c and then returned to the initial position.

On the other hand, the film sheet S pinched between the rollers of the first convey roller pair 38 is conveyed through the convey path 36 to reach the first and second slow-scan roller pairs 40, 41. Then, the laser beam B modulated in response to an image signal is emitted from the light source 48 of the optical unit 32. The laser beam is scanned by the rotatable polygon mirror 47 to send the laser beam to the film sheet through the scan lenses 52, 53, thereby forming the image on the film sheet. The film sheet S is conveyed through the convey path 37 while the image is being formed on the film sheet. The recording is finished immediately before the tip end of the film sheet S reaches the second convey roller pair 39.

If the film sheet S is stored without development, the film sheet S is conveyed by the second convey roller pair 39 until a trail end of the film sheet S passes through the movable guide 44. At this point, a detection means (not shown) detects the fact that the trail end of the film sheet S has passed through the movable guide 44, with the result that the movable guide 44 is shifted from the open position to the closed position and the second convey roller pair 39 is rotated reversely. As a result, the film sheet S is sent into the convey path 43 along the movable guide 44 and then is discharged into the receiver magazine 33 by the receiving convey roller pair 42. At this point, the lower roller of the receiving convey roller pair 42 is shifted to the broken line position so that the film sheet S can be dropped into the receiver magazine without being caught by the rollers.

On the other hand, when the image recorded on the film sheet S is subsequently developed, the film sheet S is conveyed from the second convey roller pair 39 to the convey path 71 of the connection unit 70. As shown in FIG. 3, immediately after a right corner of the tip end of the film sheet S reaches the third convey roller pair 72, the trail end of the film sheet S leaves the second convey roller pair 39. The film sheet S is conveyed while maintaining its posture by the third convey roller pair 72 toward an upward direction inclined by the angle θ to reach the fourth convey roller pair 73.

Immediately after the tip end of the film sheet S conveyed toward the upward inclined direction by the third and fourth convey roller pairs 72, 73 reaches the fifth convey roller pair 63, the trail end of the film sheet S leaves the fourth convey roller pair 73, and the conveying direction of the film sheet S is returned back by the angle θ by the fifth convey roller pair 63 so that the film sheet is conveyed toward the vertical direction parallel with the original conveying direction. As a result, the film sheet S is sent into the convey path 62 in a condition that the film sheet is shifted laterally by the distance A. After the image on the film sheet S is developed in the developing apparatus 60, the film sheet is discharged through the discharge opening 61.

In the illustrated embodiment, an example that two pairs of inclined rollers are used in order to convey the film sheet S being shifted was explained, but the present invention is not limited to such an example. Further, so long as the convey means such as the convey roller pairs disposed at upstream and downstream sides of the inclined convey roller pair(s) are spaced apart from each other by the distance smaller than the length L of the film sheet S, only one pair of inclined convey rollers may be used.

Figure 4:
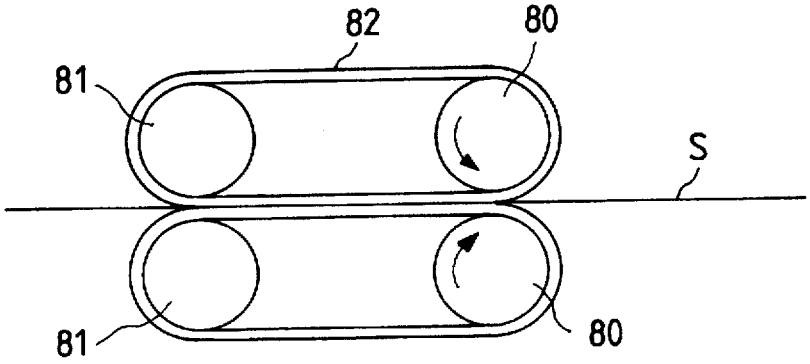
FIG. 4 is a schematic side view showing another embodiment of a convey means.

Further, the convey means are not limited to the rollers, but, for example, as shown in FIG. 4, a pair of belts 82 each of which is mounted around a drive roller 80 and a free-rotatable roller 81 and which are contacted with each other may be used. In this case, as the drive rollers 80 are rotated, the film sheet S is pinched between and conveyed by the moving belts 82.

Figure 5:
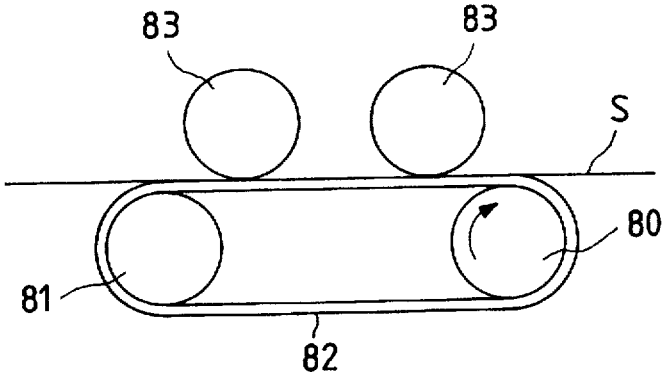
FIG. 5 is a schematic side view showing a further embodiment of a convey means.

Furthermore, as shown in FIG. 5, the convey means may be constituted by a belt 82 which is mounted around a drive roller 80 and a free-rotatable roller 81, and convey rollers 83 urged against the belt 82. In this case, the film sheet S is pinched between the convey rollers 83 and conveyed by the belt 82.

Figure 6:
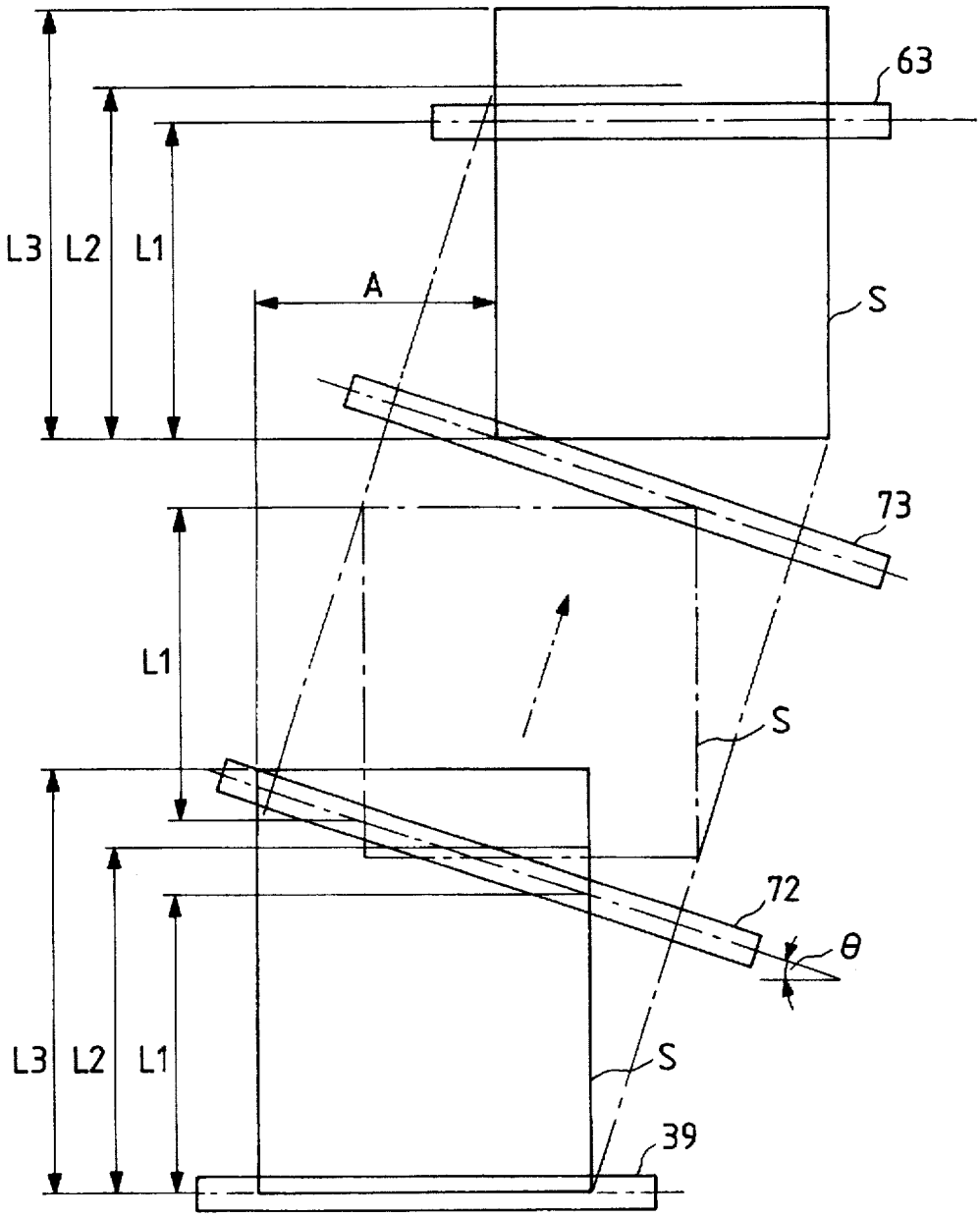
FIG. 6 is an explanatory view showing arrangement of a convey means in a shift convey mechanism according to a second embodiment.

FIG. 6 shows a second embodiment of the present invention. In this embodiment, as is in the first embodiment, the third and fourth convey roller pairs 72, 73 are disposed in parallel with each other and are inclined with respect to the vertical direction by an angle 8. However, the second, third, fourth and fifth convey roller pairs 39, 72, 73, 63 are spaced apart from each other by a distance L1. The distance L1 correspond to a length (in the conveying direction) of the minimum film sheet S among the film sheets having lengths L1, L2, L3 available to the image recording apparatus. Further, in the third, fourth and fifth convey roller pairs 72, 73, 63, at least one of rollers can be separated from the other roller.

In the sheet convey apparatus having the above-mentioned arrangement, the tip end of the film sheet S conveyed by the second convey roller pair 39 of the image recording apparatus 30 enters between the rollers (which are now stopped and separated from each other) of the third convey roller pair 72, and the trail end of the film sheet S leaves the second convey roller pair 39. Then, the separated rollers of the third convey roller pair 72 are contacted with each other and are rotated with the interposition of the film sheet S, so that the film sheet is conveyed toward an upward direction inclined by the angle 8 to reach the fourth convey roller pair 73. The film sheet S is further conveyed toward the upward inclined direction by the third and/or fourth convey roller pairs 72, 73 until the lead end of the film sheet S enters between the rollers (which are now stopped and separated from each other) of the fifth convey roller pair 63 and the left corner of the trail end of the film sheet S leaves the fourth convey roller pair 73. Immediately before the left corner of the trail end of the film sheet S leaves the fourth convey roller pair 73, the separated rollers of the fifth convey roller pair 63 are contacted with each other and are rotated with the interposition of the film sheet S to send the film sheet S into the convey path 62.

Accordingly, although the size (in the conveying direction) of the available film sheet is limited to a given one in the first embodiment, in the second embodiment, a film sheet having a smaller length can also be treated.

Incidentally, when the film sheet S having the maximum length L3 in the conveying direction is conveyed, if the right corner of the lead end of the film sheet S reaches the fourth convey roller pair 73 before the trail end of the film sheet S leaves the second convey roller pair 39, the rollers of the fourth convey roller pair 73 may be previously separated from each other as is in the third convey roller pair 72. Further, the roller pairs to be separated are not limited to the above example, but, any combinations shown in a Table 1 can be adopted:

TABLE 1

| roller pair pattern | P1 | P2 | P3 | P4 |
|---|---|---|---|---|
| second pair 39 | x | x | o | o |
| third pair 72 | o | o | x | x |
| fourth pair 73 | x | o | x | o |
| fifth pair 63 | o | x | o | x |

Incidentally, a symbol o denotes a roller pair to be separated, and a symbol x denotes a roller pair not to be separated.

Although the above-mentioned example corresponds to the pattern P1 in the Table 1, for example, in case of the pattern P4, the operation is effected as follows: at the same time when the right corner of the lead end of the film sheet S conveyed by the second convey roller pair 39 between the rotating rollers of the third convey roller pair 72 and the film sheet S is conveyed by the third convey roller pair 72 toward the upward inclined direction, the rollers of the second convey roller pair 39 are separated from each other. The film sheet S conveyed by the third convey roller pair 72 is further conveyed by the fourth convey roller pair 73, so that the lead end of the film sheet S is inserted between the rotating rollers of the fifth convey roller pair 63. At the same time when the film sheet S is conveyed by the fifth convey roller pair 63, the rollers of the fourth convey roller pair 73 are separated from each other, and the film sheet S is sent into the convey path 62.

FIGS. 7A to 7F show a construction of a third embodiment of the present invention. In this third embodiment, the second, third, fourth and fifth convey roller pairs 39, 72, 73, 63 are disposed in a relative positional relation same as those of the first and second embodiments, but, a curvature of the outer guide 71*a* is smaller than a curvature of the inner guide 71*b* so that a distance between the guides 71*a*, 71*b* is increased at the bent portions.

Figure 7A:
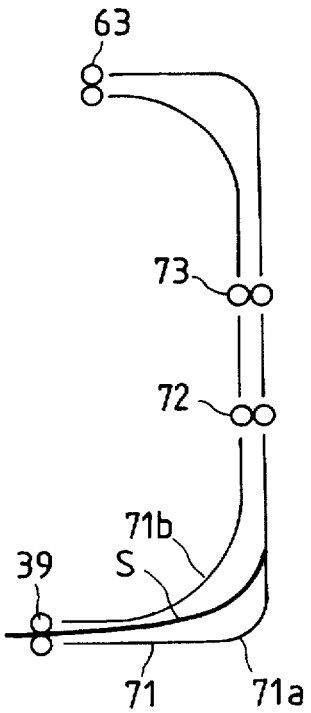
FIGS. 7A to 7F are explanatory views showing film conveying conditions in various steps according to a third embodiment.
Figure 7B:
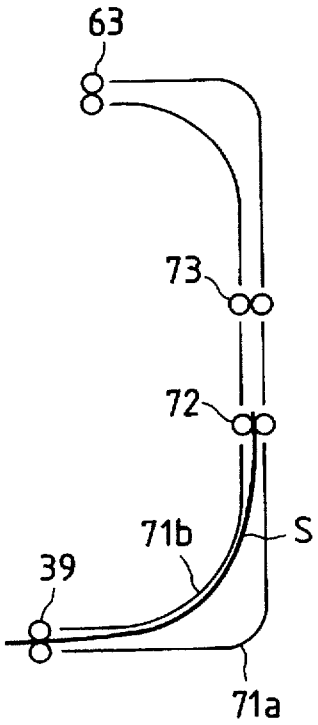
Figure 7C:
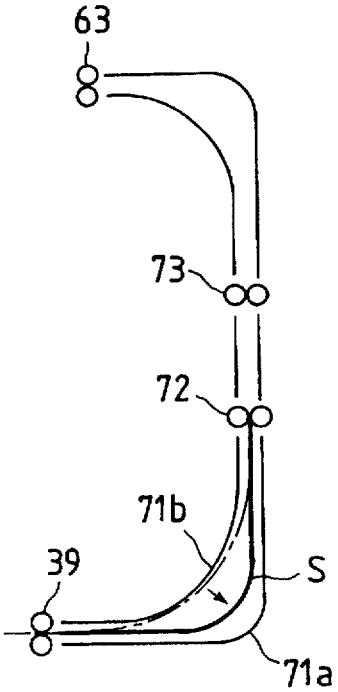
Figure 7D:
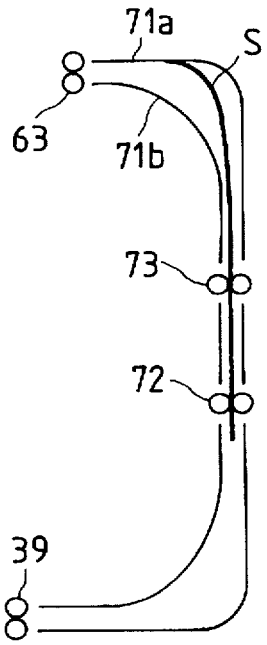
Figure 7E:
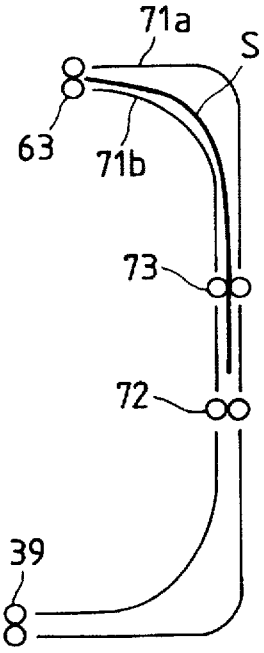
Figure 7F:
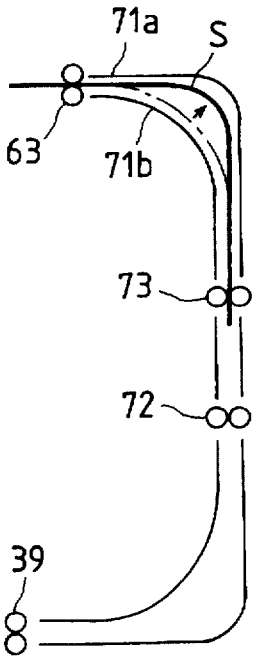
Figure 8:
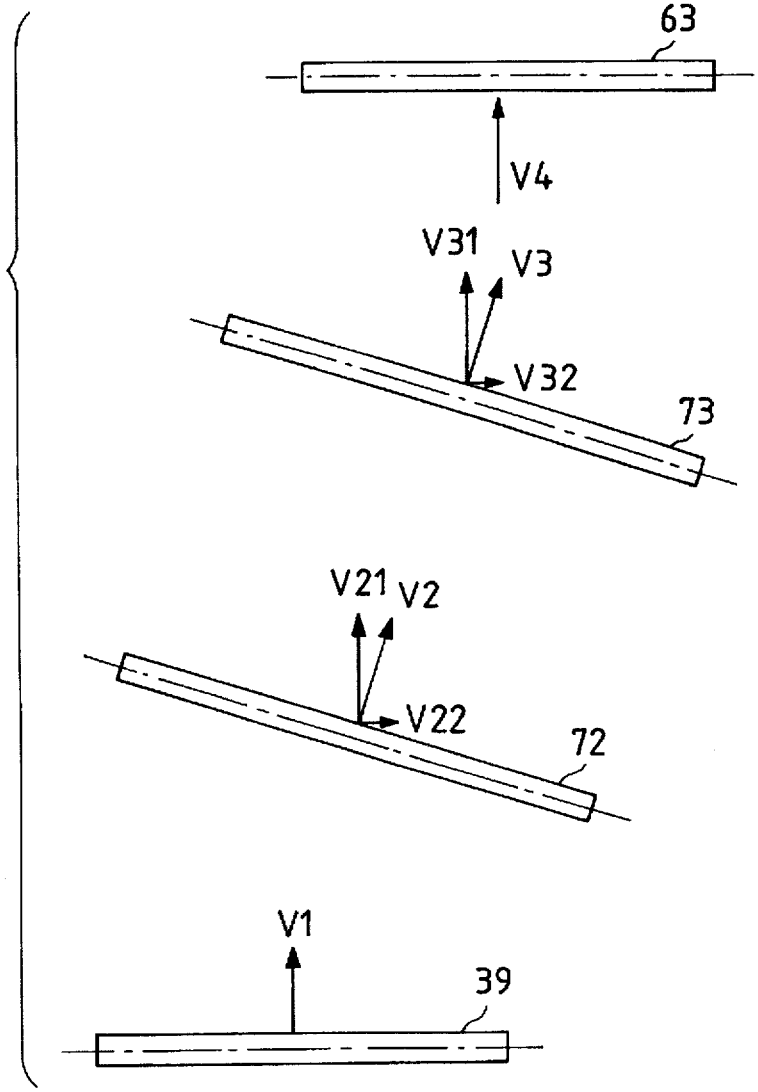
FIG. 8 is an explanatory view for explaining a convey speed.

Further, as shown in FIG. 8, it is assumed that film sheet convey speeds of the second and fifth convey roller pairs 39, 63 are V1, V4, respectively, and film sheet convey speeds of the third and fourth convey roller pairs 72, 73 are V2, V3, respectively. In addition, it is assumed that speed components of the convey speeds V2, V3 which direct to the same direction as the convey speeds V1, V4 are V21, V31, respectively, and speed components of the convey speeds V2, V3 which direct to a direction perpendicular to those of the convey speeds V1, V4 are V22, V32, respectively. In these situations, a relation between the convey speeds of the convey roller pairs is set to V4<V31=V21<V1. Incidentally, as shown in FIGS. 7A to 7F, although the actual conveying directions of the roller pairs are different in the planes of FIGS. 7A to 7F, the convey speeds V1 to V4 are considered as the speed components in plane of the film sheet S to be conveyed.

In the sheet convey apparatus having the above-mentioned arrangement, as is in the above-mentioned embodiment, after the recording is finished, the lead end of the film sheet S conveyed by the second convey roller pair 39 is guided upwardly along the guide 71*a* as shown in FIGS. 7A and 7B to reach the third convey roller pair 72. In this case, the film sheet S is adjacent to the inner guide 71*b* due to the resiliency of the film itself (force resisting against deformation of the film). The film sheet S reached the third convey roller pair 72 is conveyed toward the upward vertical direction by the third convey roller pair 72.

However, as mentioned above, since the vertical component V21 of the convey speed V2 is smaller than the convey speed V1, as shown in FIG. 7C, the film sheet S is flexed toward the outer guide 71*a*, with the result that the lead end of the film sheet S is conveyed by the third convey roller pair 72 toward the upward inclined direction and the trail end of the film sheet is conveyed linearly by the second convey roller pair 39 without exerting excessive forces having different directions onto the film sheet S. After the trail end of the film sheet S leaves the second convey roller pair 39, the lead end of the film sheet is conveyed by the third and fourth convey roller pairs 72, 73 and is guided toward the left by the outer guide 71*a* as shown in FIGS. 7D and 7E to reach the fifth convey roller pair 63. In this way, the film sheet is conveyed toward a direction parallel with the conveying direction of the second convey roller pair 39 but in an opposite to the conveying direction.

In this case, similar to the above, since V31>V4, as shown in FIG. 7F, the film sheet S is flexed toward the outer guide 71*a*, with the result that the stable and positive conveyance is continued without exerting excessive forces onto the film sheet S. When the trail end of the film sheet S leaves the fourth convey roller pair 73, the film sheet has been completely shifted, and, thus, unlike to the second embodiment, the rollers of the fourth convey roller pair are not required to be separated from each other.

In the third embodiment, when the film sheet S conveyed by the fourth convey roller pair 73 is entered into the fifth convey roller pair 63, since the speed component V31 of the convey speed of the fourth convey roller pair 73 disposed at a downstream side of the fifth convey roller pair in the film conveying direction is greater than the convey speed V4, registration effect for correcting the inclination of the film sheet S can also be achieved. That is to say, the lead end of the film sheet S abuts against the nip of the fifth convey roller pair 63 due to the elastic force of the flexed film sheet so that the film sheet is corrected to be positioned perpendicular to the nip of the fifth convey roller pair 63.

Further, the third embodiment can be applied to form various convey path, as well as a U-shaped convey path shown in FIGS. 3 and 6. For example, when the third embodiment is applied to a convey path in a flat plane, it is possible to shift the film sheet as is in the above-mentioned embodiments, by flexing the film sheet S in the following manner.

Figure 9A:
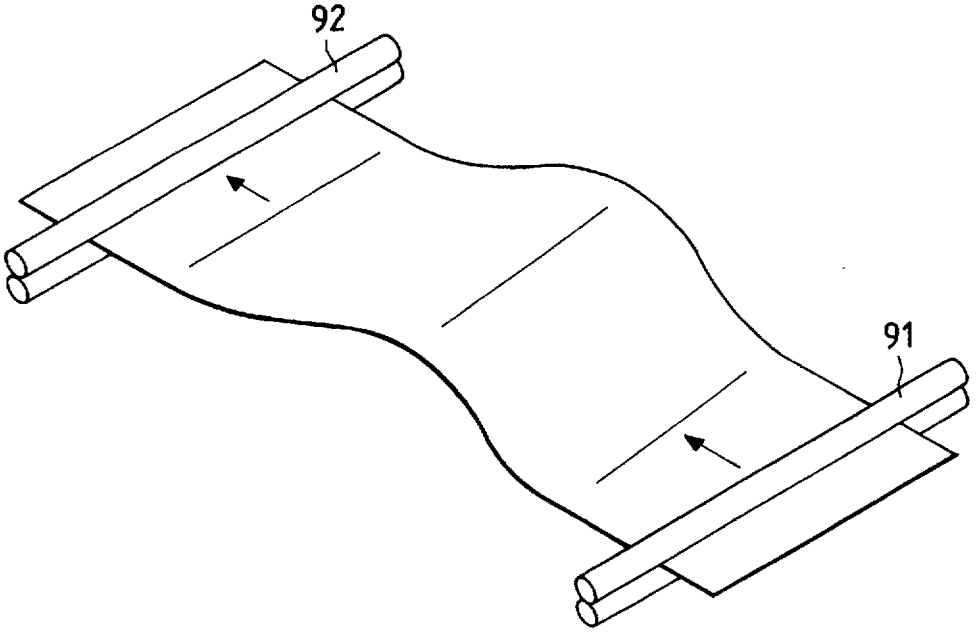
FIGS. 9A and 9B are explanatory views showing film flexed conditions generated by arrangement of the convey means.
Figure 9B:
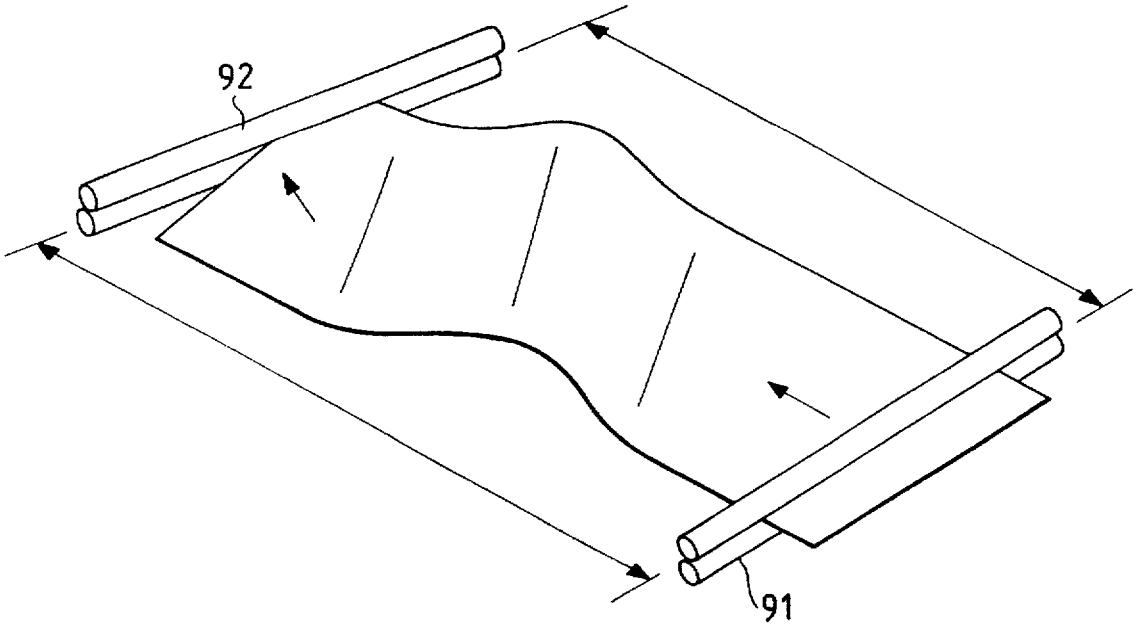

That is to say, as shown in FIG. 9A, when a convey roller pair 91 and a convey roller pair 92 adjacent to the convey roller pair 91 and having a convey speed smaller the convey speed for the film sheet S are disposed in parallel with each other, the flexion in the film sheet S is generated in parallel with the convey roller pairs 91, 92. However, if the convey roller pairs 91, 92 are not parallel with each other, as shown in FIG. 9B, the flexion in the film sheet S is generated through a zone extending from the vicinity of the convey roller pair 91 at the wider side to the vicinity of the convey roller pair 92 at the narrower side. In any cases, the film sheet S can be shifted without exerting the excessive force onto the film sheet.

Figure 10:
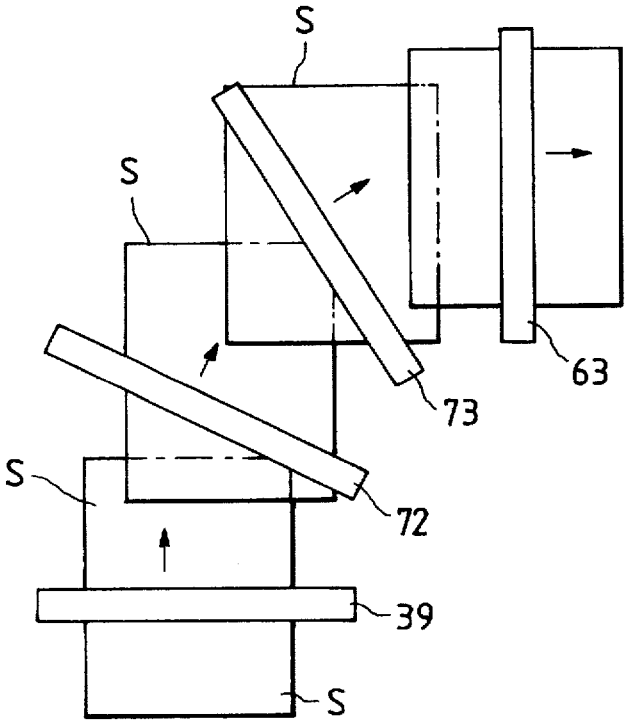
FIG. 10 is an explanatory view showing arrangement of a shift convey mechanism according to another embodiment.

In the above-mentioned embodiments, while an example that the initial conveying direction of the film sheet S is the same as the final conveying direction of the film sheet was explained, the present invention is not limited to such an example. For example, as shown in FIG. 10, the second, third, fourth and fifth convey roller pairs 39, 72, 73, 63 may be disposed in such a manner that the inclination angles of the roller pairs are gradually increased, thereby orienting the fifth convey roller pair 63 perpendicular to the second convey roller pair 39. In this case, the conveying direction of the film sheet S can be changed by 90° degrees.

Figure 11:
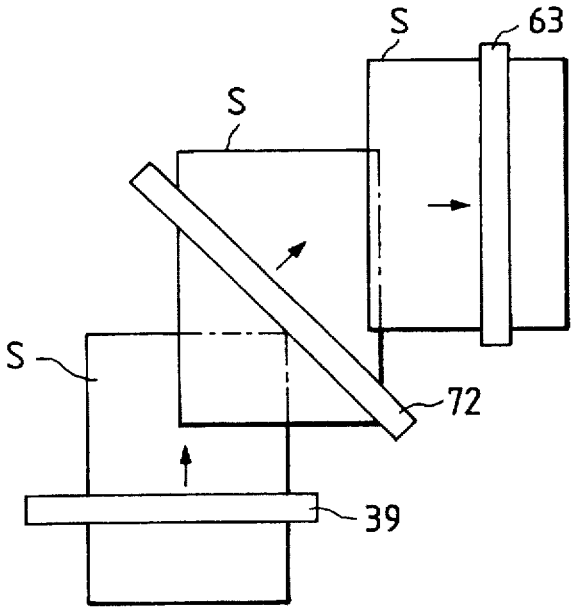
FIG. 11 is an explanatory view showing arrangement of a shift convey mechanism according to a further embodiment.

Further, as shown in FIG. 11, the fourth convey roller pair 73 may be omitted and the arrangement similar to FIG. 10 may be adopted.

As mentioned above, in the sheet convey apparatus according to the present invention, since the sheet is conveyed by the first, second and third convey means while shifting the sheet, the exclusive means for shifting the sheet is not required. In addition, since the sheet is shifted while the sheet is being continuously conveyed, the sheet conveying time can be reduced, and the stable and positive conveyance of the sheet can be achieved. Further, since the construction is simple, the apparatus can be manufactured cheaply.

What is claimed is:

1. A sheet convey apparatus comprising:

a first pair of convey means at least one of which has a driving force and which are adapted to pinch and convey a sheet;

a second pair of convey means at least one of which has a driving force and which are adapted to pinch and convey the sheet, said second pair of convey means being disposed at a downstream side of and adjacent to said first pair of convey means; and a third pair of convey means at least one of which has a driving force and which are adapted to pinch and convey the sheet, said third pair of convey means being disposed at a downstream side of and adjacent to said second pair of convey means, wherein the sheet is conveyed by at least one of said first, second and third pair of convey means, and a conveying direction of said second pair of convey means is different from those of said first and third pair of convey means without being perpendicular to the conveying directions of either one of said first and third pairs of convey means, and wherein each of said first pair of convey means, said second pair or convey means and said third pair of convey means is constructed so that any selected pair of convey means may be spacingly disposed so as not to be able to contribute to conveyance of said sheet.

2. An apparatus according to claim 1, wherein at least one of said first and second pairs of convey means is a pair of convey means separable with each other.

3. An apparatus according to claim 1, wherein at least one of said second and third pairs of convey means is a pair of convey means separable with each other.

4. An apparatus according to claim 1, wherein said first to third pairs of convey means comprise a pair of rotatable rollers having a rotation driving force, respectively.

5. An apparatus according to claim 1, wherein said second pair of convey means comprise a plurality of pairs of rotatable rollers having the same conveying directions.

6. An apparatus according to claim 1, wherein a conveying direction of said first pair of convey means differs from a conveying direction of said third pair of convey means.

7. A sheet convey apparatus comprising:

a first pair of convey means at least one of which has a driving force and which are adapted to pinch and convey a sheet;

a second pair of convey means at least one of which has a driving force and which are adapted to pinch and convey the sheet, said second pair of convey means being disposed at a downstream side of and adjacent to said first pair of convey means; and a third pair of convey means at least one of which has a driving force and which are adapted to pinch and convey the sheet, said third pair of convey means being disposed at a downstream side of and adjacent to said second pair of convey means, wherein the sheet is conveyed by at least one of said first, second and third pair of convey means, and a conveying direction of said second pair of convey means is different from those of said first and third pair of convey means without being perpendicular to the conveying directions of either one of said first and third pairs of convey means, wherein a speed component of a convey speed of said second pair of convey means which directs to a direction of a convey speed of said first pair of convey means is set to be smaller than the convey speed of said first pair of convey means.

8. A sheet convey apparatus comprising:

a first pair of convey means at least one of which has a driving force and which are adapted to pinch and convey a sheet;

a second pair of convey means at least one of which has a driving force and which are adapted to pinch and convey the sheet, said second pair of convey means being disposed at a downstream side of and adjacent to said first pair of convey means; and a third pair of convey means at least one of which has a driving force and which are adapted to pinch and convey the sheet, said third pair of convey means being disposed at a downstream side of and adjacent to said second pair of convey means, wherein the sheet is conveyed by at least one of said first, second and third pair of convey means, and a conveying direction of said second pair of convey means is different from those of said first and third pair of convey means without being perpendicular to the conveying directions of either one of said first and third pairs of convey means, wherein a speed component of a convey speed of said second pair of convey means which directs to a direction of a convey speed of said third pair of convey means is set to be greater than the convey speed of said third pair of convey means.

9. An apparatus for forming an image on a film sheet, comprising:

an image forming unit for the image on the film sheet;

a convey unit for conveying the film sheet, said convey unit comprising:

(a) a first pair of convey means at least one of which has a driving force and which are adapted to pinch and convey a sheet;

(b) a second pair of convey means at least one of which has a driving force and which are adapted to pinch and convey the sheet, said second pair of convey means being disposed at a downstream side of and adjacent to said first pair of convey means; and (c) a third pair of convey means at least one of which has a driving force and which are adapted to pinch and convey the sheet, said third pair of convey means being disposed at a downstream side of and adjacent to said second pair of convey means, and wherein a conveying direction of said second pair of convey means is different from those of said first and third pair of convey means without being perpendicular to the conveying direction of either one of said first and third pairs of convey means, and wherein each of said first pair of convey means, said second pair of convey means and said third pair of convey means is constructed so that any selected pairs of convey means may be spacingly disposed so as not to be able to contribute to conveyance of said sheet.

10. An apparatus according to claim 9, further comprising a developing unit for developing the image on the film sheet, wherein the film sheet on which the image was formed in said image forming unit is conveyed by said first to third pairs of convey means to said developing portion.

11. An apparatus according to claim 10, wherein said developing unit is disposed at an upstream side of said image forming unit, and a film convey path defined by said first to third pairs of convey means is curved from below to above.

12. An apparatus for forming an image on a film sheet, comprising:

an image forming unit for the image on the film sheet;

a convey unit for conveying the film sheet, said convey unit comprising:

(a) a first pair of convey means at least one of which has a driving force and which are adapted to pinch and convey a sheet;

(b) a second pair of convey means at least one of which has a driving force and which are adapted to pinch and convey the sheet, said second pair of convey means being disposed at a downstream side of and adjacent to said first pair of convey means; and (c) a third pair of convey means at least one of which has a driving force and which are adapted to pinch and convey the sheet, said third pair of convey means being disposed at a downstream side of and adjacent to said second pair of convey means, and wherein a conveying direction of said second pair of convey means is different from those of said first and third pair of convey means without being perpendicular to the conveying direction of either one of said first and third pairs of convey means, wherein a speed component of a convey speed of said second pair of convey means which directs to a direction of a convey speed of said first pair of convey means is set to be smaller than the convey speed of said first pair of convey means.

13. An apparatus for forming an image on a film sheet, comprising:

an image forming unit for the image on the film sheet;

a convey unit for conveying the film sheet, said convey unit comprising:

(a) a first pair of convey means at least one of which has a driving force and which are adapted to pinch and convey a sheet;

(b) a second pair of convey means at least one of which has a driving force and which are adapted to pinch and convey the sheet, said second pair of convey means being disposed at a downstream side of and adjacent to said first pair of convey means; and (c) a third pair of convey means at least one of which has a driving force and which are adapted to pinch and convey the sheet, said third pair of convey means being disposed at a downstream side of and adjacent to said second pair of convey means, and wherein a conveying direction of said second pair of convey means is different from those of said first and third pair of convey means without being perpendicular to the conveying direction of either one of said first and third pairs of convey means, wherein a speed component of a convey speed of said second pair of convey means which directs to a direction of a convey speed of said third pair of convey means is set to be greater than the convey speed of said third pair of convey means.

* * * * *

UNITED STATES PATENT AND TRADEMARK OFFICE

CERTIFICATE OF CORRECTION

PATENT NO. : 5,729,816
DATED : March 17, 1998
INVENTOR(S) : Kazuhiro MATSUMOTO, et al.

It is certified that error appears in the above-identified patent and that said Letters Patent is hereby corrected as shown below:

Column 5, line 15, delete "8" and insert therefor --$\theta$--.

Column 8, line 13, delete "or" and insert therefor --of--;
Lines 19 and 22, delete "with", both occurrences, and insert therefor --from--.

Signed and Sealed this

Fifteenth Day of September, 1998

*Attest:*

*Attesting Officer*

Bruce Lehman

BRUCE LEHMAN

*Commissioner of Patents and Trademarks*